United States Patent [19]

Straitz, III

[11] 4,137,036

[45] Jan. 30, 1979

[54] FLARE BURNER

[75] Inventor: John F. Straitz, III, Meadowbrook, Pa.

[73] Assignee: Combustion Unlimited Incorporated, Jenkintown, Pa.

[21] Appl. No.: 781,849

[22] Filed: Mar. 28, 1977

[51] Int. Cl.[2] ..... F23M 9/00

[52] U.S. Cl. ..... 431/202; 431/285

[58] Field of Search ..... 431/202, 285, 5

[56] References Cited

U.S. PATENT DOCUMENTS

| | | | |
|---|---|---|---|
| 3,033,273 | 5/1962 | Zink | 431/285 X |
| 3,779,689 | 12/1973 | Reed | 431/202 X |
| 3,852,023 | 12/1974 | Itoh | 431/202 |
| 3,885,919 | 5/1975 | Pillard | 431/285 X |

*Primary Examiner*—Alan Cohan

*Attorney, Agent, or Firm*—Zachary T. Wobensmith, 2nd; Zachary T. Wobensmith, III

[57] ABSTRACT

A flare burner is described having a central combustion chamber which is open at the top for discharge of combustion products and elevated and open at the bottom for entrance of air for combustion, the central combustion chamber being surrounded by a cylindrical enclosure which is open at the top for the discharge of combustion products and elevated and open at the bottom for entrance of air for combustion in the central combustion chamber and which also provides a combustion chamber outside the central combustion chamber, a plurality of stages of combustion are provided one in the central combustion chamber and another in the cylindrical enclosure. An acoustical and wind shielding fence is provided outside the bottom of the cylindrical enclosure over which air passes to enter the bottom of the enclosure.

2 Claims, 3 Drawing Figures

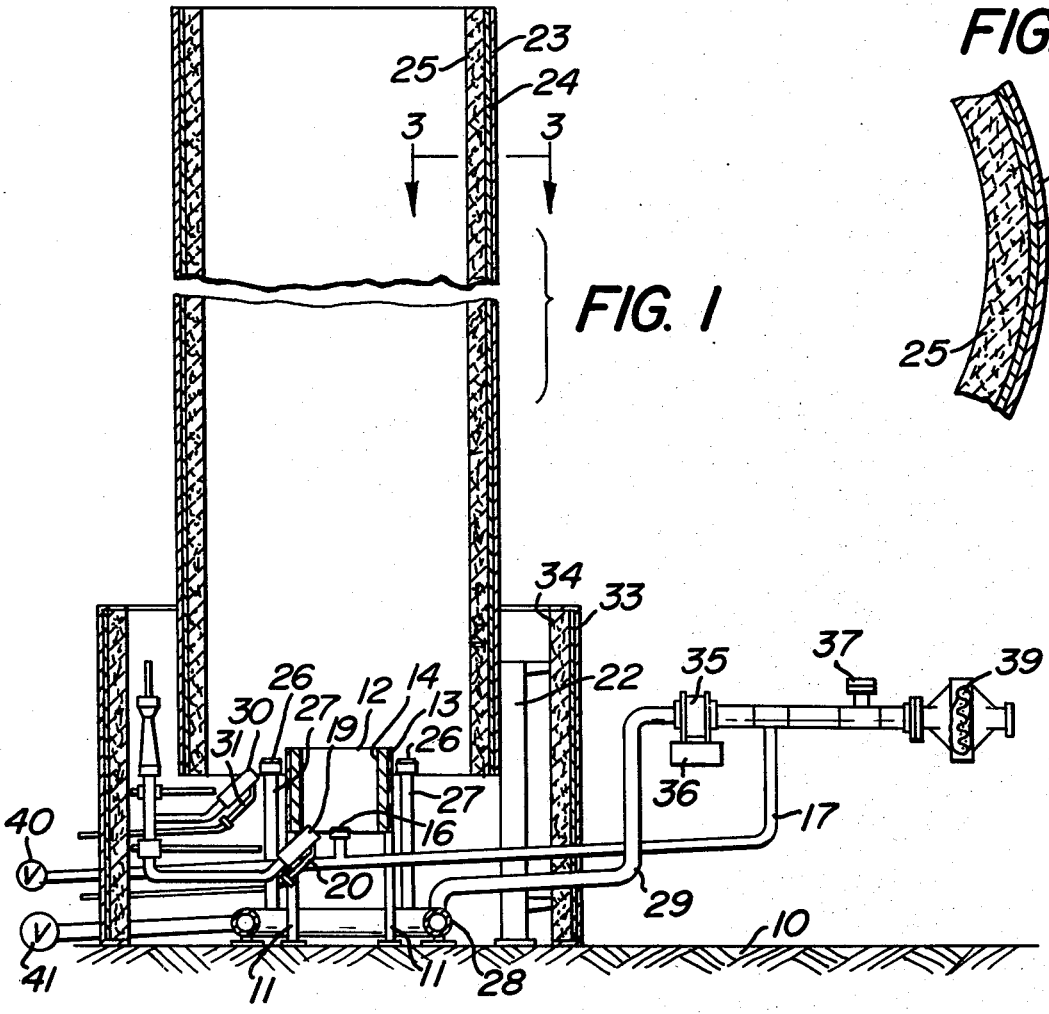
FIG. 1
FIG. 3
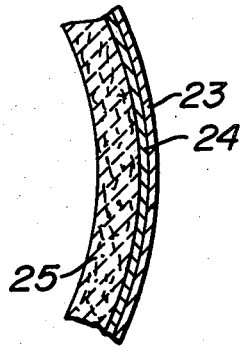
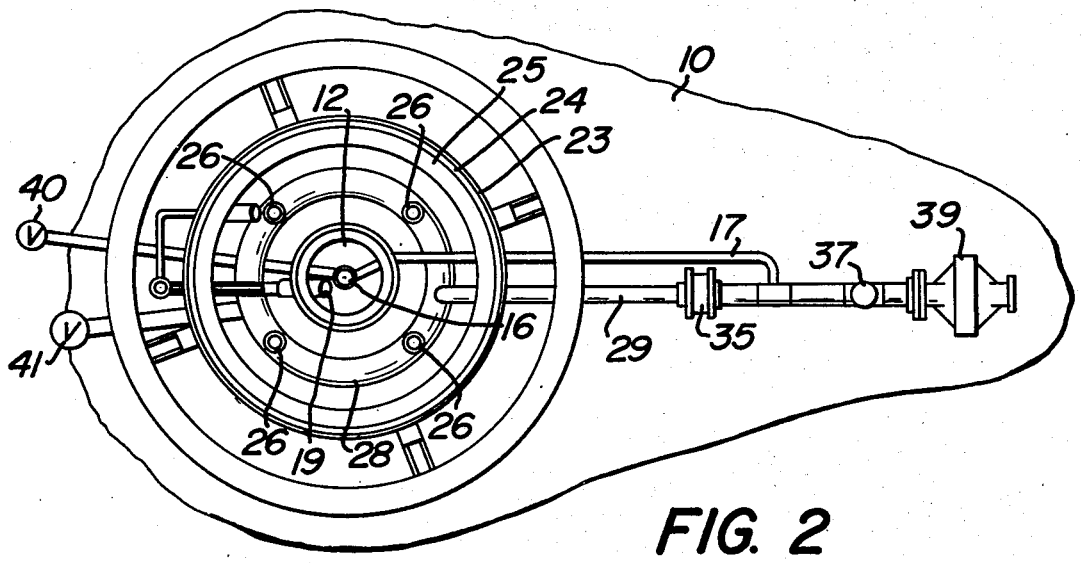
FIG. 2

FLARE BURNER

BACKGROUND OF THE INVENTION

1. Field of the Invention

This invention relates to flare stacks and more particularly to such stacks for the burning of waste combustible gases.

2. Description of the Prior Art

It has heretofore been proposed to burn waste gases employing successive stages to accommodate varied quantities of the gas to be burned.

Nahas, in U.S. Pat. No. 3,322,178, shows a flare apparatus for staged combustion in a pit below ground level, Venturi burners being disposed along the sides of the pit.

Hoy et al., in U.S. Pat. No. 3,881,857, show a combustor with a chamber divided into a plurality of zones having increasing numbers of air tubes so that progressively increasing areas may be ignited.

Beck, in U.S. Pat. No. 2,625,992, shows in a flat burner arrangement multiple gas burners in groups with provisions for utilizing a plurality of groups sequentially as required.

Reed et al., in U.S. Pat. No. 3,749,546, show in a flat pit burner a plurality of flow lines connected to a plurality of burners for utilization in stages, determined by the pressure of the gas.

The foregoing all require a relatively large flat surface area with the combustion exposed to view from the surrounding land area.

Pillard et al., in U.S. Pat. No. 3,885,919, show a residual gas burner with a smoke evacuating conduit at the base and a plurality of superposed coaxial combustion chambers of increasing volume with gas supplied to a number of burners varying in the same manner as the out flow of gases.

The waste gas burners of the staged type heretofore available require excessive area, do not adequately conceal the combustion glare and noise and have other shortcomings.

SUMMARY OF THE INVENTION

In accordance with the invention a flare burner is provided having an interior central combustion chamber for waste combustible gas, the interior chamber being surrounded by a cylindrical enclosure which is open at the top for the discharge of combustion products and is open at the bottom for the entrance of air, the enclosure having a combustion chamber outside the interior chamber, the enclosure extending upwardly for combustion in the central combustion chamber and in the enclosure, and having another stage of combustion, an acoustical and wind shielding enclosure being provided outside the bottom of the cylindrical enclosure over which the air passes to enter the bottom of the enclosure.

It is the principal object of the invention to provide a flare burner which is effective in the disposal of waste combustible gases, which does not require excessive area for installation and which does not adversely effect the nearby area by transmission of odors, noise or glare.

It is a further object of the invention to provide a flare burner which can accommodate a wide range of flow rates with stages of increasing capacity for this purpose.

It is a further object of the invention to provide a flare burner which is compact and effective in its disposal of waste combustible gas.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which:

FIG. 1 is a vertical central sectional view of a flare burner in accordance with the invention;

FIG. 2 is a top plan view of the flare burner shown in FIG. 1; and

FIG. 3 is a fragmentary horizontal sectional view, enlarged, taken approximately on the line 3—3 of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings in which a preferred embodiment is shown a foundation 10 is provided which supports, on upright posts 11, and spaced above the foundation 10, a central interior combustion chamber 12.

The combustion chamber 12 has a cylindrical wall 13 of metal, with an interior lining 14 of heat and sound insulating material, preferably of a stable high temperature alumina silica ceramic fibrous material, or if desired, of cast ceramic refractory material.

Within the combustion chamber 12, and at the bottom thereof, a waste gas burner nozzle 16 is provided with waste combustible gas supplied thereto by a waste gas supply pipe 17. The burner nozzle 16 can be of any desired type but those shown in the U.S. Pat. No. 3,463,602 to Gordon M. Bitterlich are suitable. A pilot 19 and igniter pipe 20 therefor are provided for igniting the combustible gas from the burner nozzle 16.

In surrounding relation to the combustion chamber 12, and spaced outwardly therefrom and supported on posts 22, a cylindrical metallic enclosing wall or shell 23 is provided, open at the top and at the bottom and spaced above the foundation 12 for entry of air thereinto and into the interior combustion chamber 12. The wall 23 preferably has an interior coating of a bitumastic coating 24 (see FIG. 3) to reduce corrosion by sulfur components of the waste combustible gas released by combustion, and an interior lining 25 of heat and sound insulating material, preferably of a stable high temperature alumina silica ceramic fibrous material.

Within the shell 23 and preferable contiguous to the upper end of the combustion chamber 12, a plurality of burner nozzles 26 are provided carried on vertical waste gas supply pipes 27 which are carried on a manifold 28. The burner nozzles 26 are preferably the same as or are similar to the burner nozzle 16. Waste combustible gas is supplied to the manifold 28 by a waste gas supply pipe 29. A pilot 30 and igniter pipe 31 therefor are provided for igniting the combustible gas from one of the burner nozzles 26 the others being ignited by the burning gas from the nozzle 26.

In surrounding relation to the bottom of the shell 23, and extending thereabove, an enclosing metal acoustical fence 33 is provided, having a lining 34 similar to the lining of the shell 23 which also serves as a wind shield and glare shield.

The waste gas supply pipe 29 has a value 35 interposed therein which may be controlled by a valve positioner 36, if desired, and with the gas supply pipe 17 connected upstream thereof.

The waste gas supply pipe 29 preferably has interposed therein a flow sensor 37 for activating the positioner 36 upon increase in flow beyond that of the capacity of the burner nozzle 16.

Upstream in the pipe 29, a flame arrester 39 is preferably provided to prevent back firing in the gas supply pipe 29.

The waste gas supply pipes 17 and 29 are preferably supplied with drain valves 40 and 41 for removal of water in these pipes.

The mode of operation will now be pointed out.

Assume that waste combustible gas is supplied through the supply pipe 29. The waste gas will be supplied first through the pipe 17 and delivered through the burner nozzle 16 for ignition by the pilot 19 and combustion in the combustion chamber 12. The products of combustion will move upwardly from the combustion chamber 12 and upwardly in the shell 23.

If the quantity of combustible gas for disposal increases the flow sensor 37 is effective through the valve positioner 36 to open the valve 35 to deliver gas to the burner nozzles 26 for ignition by the pilot 30.

Combustion of the gas from the burner nozzles 26 will be effected within the shell 23, and exteriorly of the combustion chamber 12. The products of combustion will move upwardly with the products of combustion from the combustion chamber 12 for discharge through the open upper end of the shell 23.

Air for combustion in the shell 23 and in the combustion chamber 12 passes over the top of the fence 33, then inwardly below the bottom of the shell 23 part moving to the bottom of the combustion chamber 12 and part moving up the exterior of the combustion chamber 12 for combustion of the waste gas from the burner nozzles 26.

The acoustical fence 33 is effective for preventing transmission outwardly of the low frequency noise attendant on the combustion and the higher frequency noise attendant on the entry of the gas and air for combustion. The fence 23, at the same time, prevents glare and heat transmission from the combustion.

I claim:

1. A flare burner comprising a combustion chamber open at the top and at the bottom and having an upper margin and having a lower margin elevated above the ground for free entry of air at the bottom for supporting combustion, a wall surrounding said combustion chamber in spaced relation thereto and having its lower margin disposed intermediate the upper and lower margins of said combustion chamber for free entry of air for distribution to said combustion chamber and free and uniform entry of air interiorly of said wall and providing a combustion space above said combustion chamber, said wall extending upwardly above the top of said combustion chamber and being open at the top for the discharge of products of combustion, members including a burner nozzle for supplying waste combustible gas to the center of the lower part of said combustion chamber for combustion therein, a waste combustible gas supply manifold below said combustion chamber, members including a plurality of burner nozzles spaced around the upper margin of said combustion chamber, connected to said supply manifold and supplying waste combustible gas upwardly in the air entry space between said combustion chamber and said wall for combustion of said waste gas, a closed shielding wall member extending upwardly from the ground in surrounding relation to said wall and extending above the lower margin of said wall in spaced relation at its top for air entry over the top of said wall member and having a sound absorbing lining in sound absorbing relation to air delivered over said wall member and below said wall and to said combustion chamber, said shielding wall member preventing access of air except at its top.

2. A flare burner as defined in claim 1 in which control means responsive to the flow of the waste combustible gas is provided for said members for supplying waste combustible gas to the interior of said wall, and for said members for supplying waste combustible gas to said combustion chamber, and said control means selectively activates burner nozzles in said respective stages in response to available waste combustible gas.

* * * * *